US012805597B2

(12) United States Patent
DiLorenzo et al.

(10) Patent No.: US 12,805,597 B2
(45) **Date of Patent: *Nov. 24, 2026**

(54) WEIGHTLIFTING SHOE

(71) Applicant: TYR Sport, Inc., Farmingdale, NY (US)

(72) Inventors: Matthew Vito DiLorenzo, Farmingdale, NY (US); Sunki Jeon, Farmingdale, NY (US); Yang Wang, Farmingdale, NY (US); Corey Berger, Farmingdale, NY (US); Aaron Horschig, Farmingdale, NY (US)

(73) Assignee: TYR Sport, Inc., Farmingdale, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/193,481

(22) Filed: Apr. 29, 2025

(65) Prior Publication Data

US 2025/0255377 A1 Aug. 14, 2025

Related U.S. Application Data

(63) Continuation of application No. 18/440,399, filed on Feb. 13, 2024, now abandoned, which is a continuation of application No. 17/734,984, filed on May 2, 2022, now Pat. No. 11,930,880.

(51) Int. Cl.
*A43B 13/04* (2006.01)
*A43B 5/00* (2022.01)

(52) U.S. Cl.
CPC ..... *A43B 13/04* (2013.01); *A43B 5/00* (2013.01)

(58) Field of Classification Search
CPC ..... A43B 13/04; A43B 13/12; A43B 13/13; A43B 5/00
See application file for complete search history.

(56) References Cited

U.S. PATENT DOCUMENTS

| | | | |
|---|---|---|---|
| 283,173 | A | 8/1883 | Washington |
| 633,697 | A | 9/1899 | Abraham |
| 719,725 | A | 2/1903 | Camille |

(Continued)

OTHER PUBLICATIONS

Supplementary European Search Report for EP 23 79 9812; mailed Apr. 2, 2026.

(Continued)

*Primary Examiner* — Bao-Thieu L Nguyen
(74) *Attorney, Agent, or Firm* — Stetina Garred Brucker & Newboles

(57) ABSTRACT

A weightlifting shoe has a bottom sole, a midsole comprising a thermoplastic polyurethane (TPU), and one or more panels attached to one or both of the midsole and the bottom sole to define an enclosure for a person's foot. The midsole may be disposed above at least a portion of the bottom sole and may have a decreasing thickness in a direction from a rear region of the bottom sole toward a front region of the bottom sole opposite the rear region. The enclosure may have an axis defined between opposing front and rear points on the enclosure at a longest part thereof and may have a width defined perpendicular to the axis. The width of the enclosure may have a maximum value at a position along the axis that is more than 70% of the way from the rear point to the front point.

26 Claims, 6 Drawing Sheets

(56) References Cited

U.S. PATENT DOCUMENTS

| | | | | |
|---|---|---|---|---|
| 858,946 | A | 7/1907 | Curtis | |
| 905,412 | A | 12/1908 | Downes | |
| 909,021 | A | 1/1909 | Pulliam | |
| 933,338 | A | 9/1909 | Poole | |
| 943,882 | A | 12/1909 | Knappich | |
| 945,752 | A | 1/1910 | Butler et al. | |
| 952,994 | A | 3/1910 | Palmer | |
| 959,109 | A | 5/1910 | Melchior | |
| 978,508 | A | 12/1910 | Sutherland et al. | |
| 991,669 | A | 5/1911 | Taylor | |
| 997,509 | A | 7/1911 | Prellwitz | |
| 998,941 | A | 7/1911 | Alvey | |
| 1,004,257 | A | 9/1911 | Orlando | |
| 1,004,926 | A | 10/1911 | Steel | |
| D283,173 | S | 4/1986 | Malone | |
| 4,651,445 | A * | 3/1987 | Hannibal | A43B 13/187 428/408 |
| 4,811,500 | A | 3/1989 | Maccano | |
| 6,041,523 | A | 3/2000 | Deloriea | |
| 6,341,432 | B1 * | 1/2002 | Muller | A43B 13/12 36/102 |
| 7,197,840 | B2 | 4/2007 | Nakano | |
| 8,336,230 | B2 | 12/2012 | Crowley | |
| 10,238,173 | B2 | 3/2019 | Ngene | |
| 10,842,224 | B2 * | 11/2020 | Farina | A43B 13/02 |
| 11,026,474 | B2 * | 6/2021 | Suffolk | A43B 7/14 |
| 11,930,880 | B2 * | 3/2024 | DiLorenzo | A43B 5/00 |
| 2004/0020077 | A1 * | 2/2004 | Thomas | A43B 7/12 12/142 E |
| 2005/0235525 | A1 * | 10/2005 | Jacobs | A43C 11/008 36/50.1 |
| 2013/0174444 | A1 * | 7/2013 | Jacobs | A43B 13/16 36/28 |
| 2013/0196829 | A1 * | 8/2013 | Elbaz | A43B 13/143 482/79 |
| 2014/0259765 | A1 * | 9/2014 | Toronjo | A43B 3/0036 36/83 |
| 2014/0290097 | A1 * | 10/2014 | Bann | A43B 13/04 36/102 |
| 2017/0095033 | A1 * | 4/2017 | Farina | A43B 13/02 |
| 2020/0170340 | A1 * | 6/2020 | Kim | A43B 13/04 |
| 2021/0059351 | A1 | 3/2021 | Piacentini | |
| 2021/0368919 | A1 | 12/2021 | Holmes et al. | |
| 2022/0053879 | A1 * | 2/2022 | Redon | A43B 13/026 |
| 2022/0125158 | A1 * | 4/2022 | Ni | A43B 13/127 |
| 2022/0400811 | A1 * | 12/2022 | Garza, Sr. | A43B 7/143 |
| 2023/0144343 | A1 * | 5/2023 | Dunning | A43B 23/08 36/88 |

OTHER PUBLICATIONS

More!, webpage <https://www.youtube.com/watch?v=j-vs150au9w>, uploaded Jun. 23, 2021.

Adidas, Adipower Weightlifting II Shoes, webpage <https://www.adidas.com/us/adipower-weightlifting-ii-shoes/GZ5954.html>, printed Jul. 26, 2022, 3 pages.

Nike, Nike Romaleos 4 Training Shoe, webpage <https://www.nike.com/t/romaleos-4-training-shoe-r7zff9/CD3463-101>, printed Jul. 26, 2022, 8 pages.

Reebok, Legacy Lifter II Men's Weightlifting Shoes, webpage <https://www.reebok.com/us/legacy-lifter-ii-men-s-weightlifting-shoes/GY8436.html>, printed Jul. 26, 2022, 3 pages.

That Fit Friend; Jake Boly, Weightlifting Shoes Guide "Do You Need Them, How They Should Fit, and More!, webpage <https://thatfitfriend.com/weightlifting-shoe-guide/>, printed Mar. 17, 2022, 25 pages."

Patent Cooperation Treaty, International Search Report and Written Opinion for International Application No. PCT/US23/18971, Jul. 19, 2023, 13 pages.

Canadian Patent Office Action for Application No. 3,251,506; mailed Jul. 13, 2026.

* cited by examiner

WEIGHTLIFTING SHOE

CROSS-REFERENCE TO RELATED APPLICATIONS

Not Applicable

STATEMENT RE: FEDERALLY SPONSORED RESEARCH/DEVELOPMENT

Not Applicable

BACKGROUND

Footwear that is designed specifically for weightlifting differs in some respects from other athletic shoes, most notably in that the heel is typically elevated. An elevated heel is thought to improve the range of motion of the weightlifter's knees and to allow for better use of the weightlifter's leg muscles during a squat. However, the elevated heel is also thought to increase the potential for slippage of the foot, which may be the reason for the tendency of weightlifting shoes to be relatively narrow and constricting along the length of the shoe including in the toe box. Although some efforts have been made to design weightlifting shoes for wide feet (just as other types of athletic shoes have wide foot styles), the existing weightlifting shoes on the market remain overly confining to the toes. In particular, the toe boxes of existing weightlifting shoes do not adequately account for the benefit to the weightlifter of being able to fully splay the toes while lifting.

BRIEF SUMMARY

The present disclosure contemplates footwear for overcoming the above drawbacks associated with the related art. One aspect of the embodiments of the present disclosure is a weightlifting shoe comprising a bottom sole, a midsole comprising a thermoplastic polyurethane (TPU), and one or more panels attached to one or both of the midsole and the bottom sole to define an enclosure for a person's foot. The midsole may be disposed above at least a portion of the bottom sole and may have a decreasing thickness in a direction from a rear region of the bottom sole toward a front region of the bottom sole opposite the rear region. The enclosure may have an axis defined between opposing front and rear points on the enclosure at a longest part thereof and may have a width defined perpendicular to the axis. The width of the enclosure may have a maximum value at a position along the axis that is more than 70% of the way from the rear point to the front point.

The maximum value of the width of the enclosure may be at a position along the axis that is more than 71% of the way from the rear point to the front point. The maximum value of the width of the enclosure may be at a position along the axis that is more than 72% of the way from the rear point to the front point. The maximum value of the width of the enclosure may be at a position along the axis that is more than 73% of the way from the rear point to the front point. The maximum value of the width of the enclosure may be at a position along the axis that is more than 74% of the way from the rear point to the front point. The maximum value of the width of the enclosure may be at a position along the axis that is more than 75% of the way from the rear point to the front point.

The width of the enclosure may be the sum of an outer foot distance defined perpendicular to the axis between the axis and the enclosure where the enclosure encloses an outer part of the person's foot and an inner foot distance defined perpendicular to the axis between the axis and the enclosure where the enclosure encloses an inner part of the person's foot. The outer foot distance may have a maximum value at a position along the axis that is more than 66% of the way from the rear point to the front point. The maximum value of the outer foot distance may be at a position along the axis that is more than 68% of the way from the rear point to the front point. The maximum value of the outer foot distance may be at a position along the axis that is more than 70% of the way from the rear point to the front point.

The width of the enclosure may be the sum of an outer foot distance defined perpendicular to the axis between the axis and the enclosure where the enclosure encloses an outer part of the person's foot and an inner foot distance defined perpendicular to the axis between the axis and the enclosure where the enclosure encloses an inner part of the person's foot. The inner foot distance may have a maximum value at a position along the axis that is more than 72% of the way from the rear point to the front point. The maximum value of the inner foot distance may be at a position along the axis that is more than 74% of the way from the rear point to the front point. The maximum value of the inner foot distance may be at a position along the axis that is more than 76% of the way from the rear point to the front point. The maximum value of the inner foot distance may be at a position along the axis that is more than 78% of the way from the rear point to the front point. The maximum value of the inner foot distance may be at a position along the axis that is more than 80% of the way from the rear point to the front point.

A heel height defined as a sum of a maximum value of the thickness of the midsole and a corresponding thickness of the bottom sole may be at least 18 mm. The heel height may be at least 20 mm.

The weightlifting shoe may comprise a plurality of shoelace eyelets and two or more straps.

Another aspect of the embodiments of the present disclosure is a weightlifting shoe comprising a bottom sole, a midsole comprising a thermoplastic polyurethane (TPU), and one or more panels attached to one or both of the midsole and the bottom sole to define an enclosure for a person's foot. The midsole may be disposed above at least a portion of the bottom sole and may have a decreasing thickness in a direction from a rear region of the bottom sole toward a front region of the bottom sole opposite the rear region. The enclosure may have an axis defined between opposing front and rear points on the enclosure at a longest part thereof and may have a width defined perpendicular to the axis. The width may be the sum of an outer foot distance defined perpendicular to the axis between the axis and the enclosure where the enclosure encloses an outer part of the person's foot and an inner foot distance defined perpendicular to the axis between the axis and the enclosure where the enclosure encloses an inner part of the person's foot. The outer foot distance may have a maximum value at a position along the axis that is more than 66% of the way from the rear point to the front point.

The maximum value of the outer foot distance may be at a position along the axis that is more than 68% of the way from the rear point to the front point. The maximum value of the outer foot distance may be at a position along the axis that is more than 70% of the way from the rear point to the front point.

Another aspect of the embodiments of the present disclosure is a weightlifting shoe comprising a bottom sole, a midsole comprising a thermoplastic polyurethane (TPU), and one or more panels attached to one or both of the midsole and the bottom sole to define an enclosure for a person's foot. The midsole may be disposed above at least a portion of the bottom sole and may have a decreasing thickness in a direction from a rear region of the bottom sole toward a front region of the bottom sole opposite the rear region. The enclosure may have an axis defined between opposing front and rear points on the enclosure at a longest part thereof and may have a width defined perpendicular to the axis. The width may be the sum of an outer foot distance defined perpendicular to the axis between the axis and the enclosure where the enclosure encloses an outer part of the person's foot and an inner foot distance defined perpendicular to the axis between the axis and the enclosure where the enclosure encloses an inner part of the person's foot. The inner foot distance may have a maximum value at a position along the axis that is more than 72% of the way from the rear point to the front point.

The maximum value of the inner foot distance may be at a position along the axis that is more than 76% of the way from the rear point to the front point. The maximum value of the inner foot distance may be at a position along the axis that is more than 80% of the way from the rear point to the front point.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
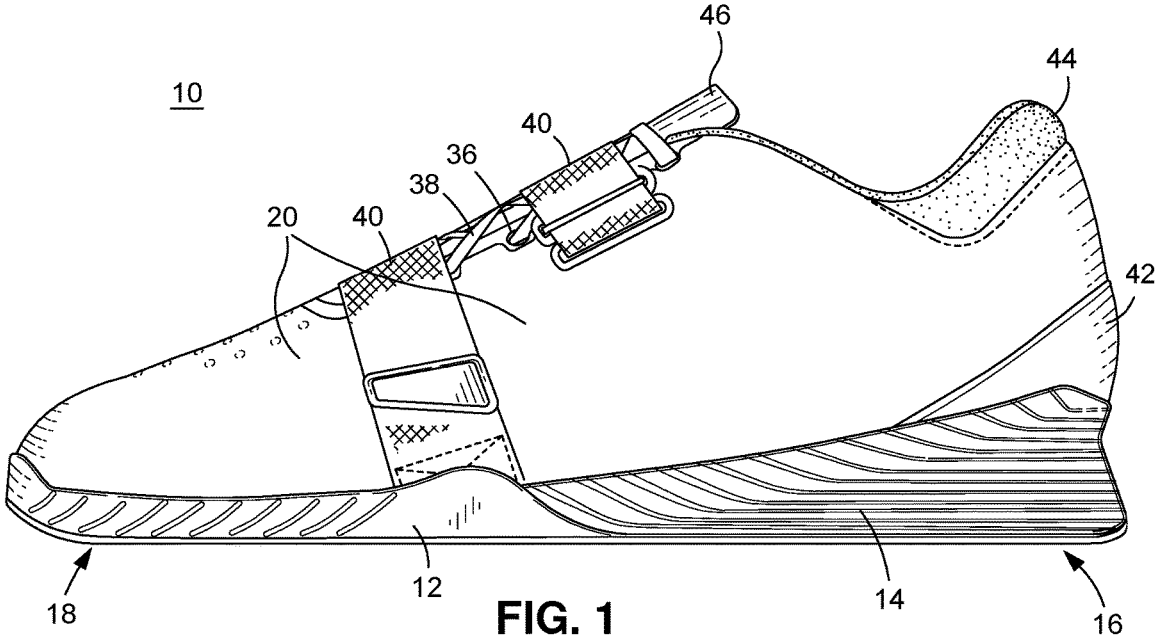
FIG. 1 is a left side view of a weightlifting shoe for a left foot, showing an outer side thereof.
Figure 2:
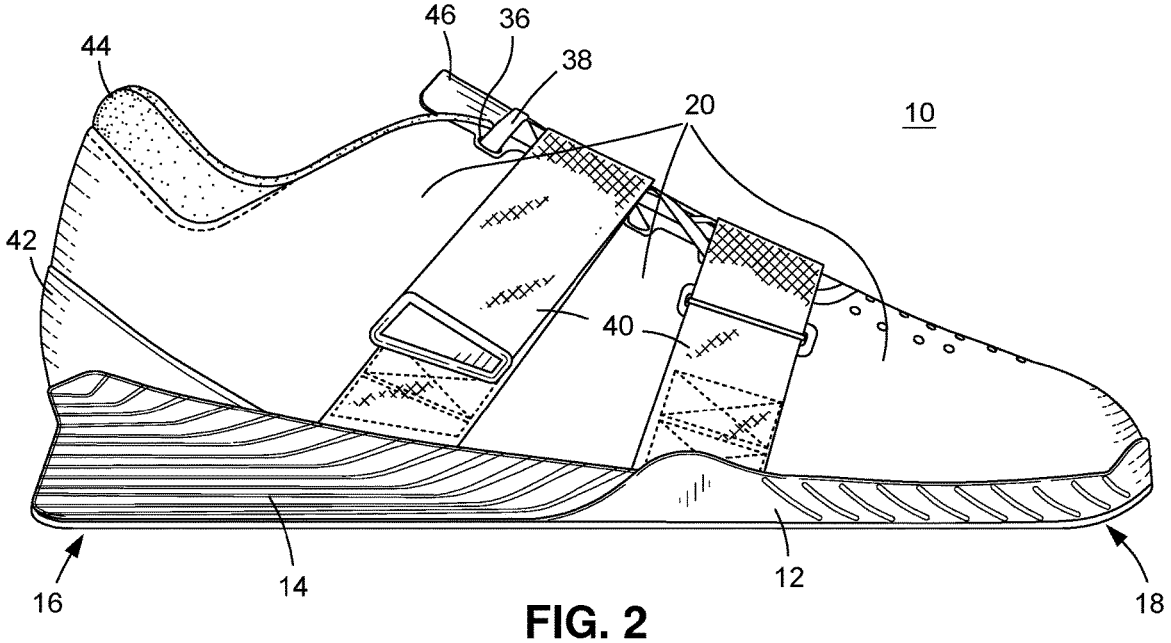
FIG. 2 is a right side view of the weightlifting shoe, showing an inner side thereof.
Figure 3:
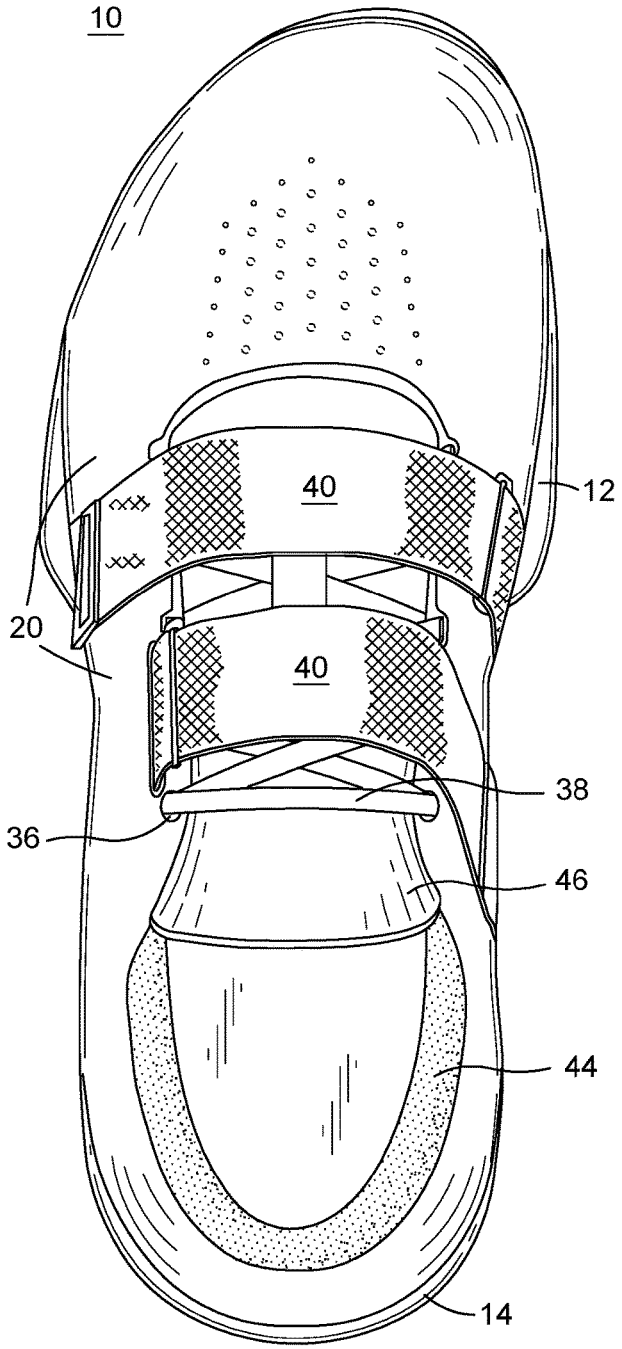
FIG. 3 is a top view of the weightlifting shoe.
Figure 4:
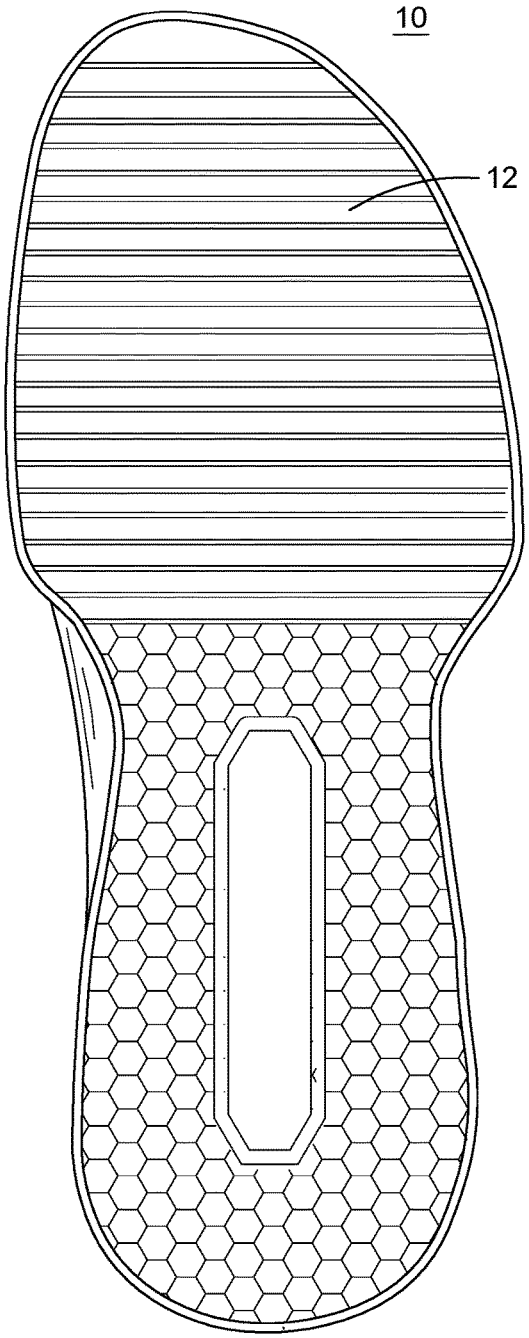
FIG. 4 is a bottom view of the weightlifting shoe.
Figure 5:
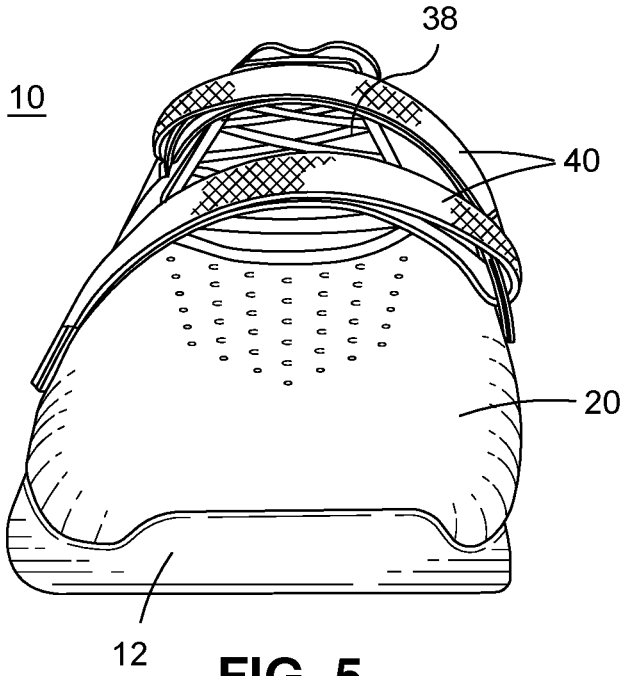
FIG. 5 is a front view of the weightlifting shoe.
Figure 6:
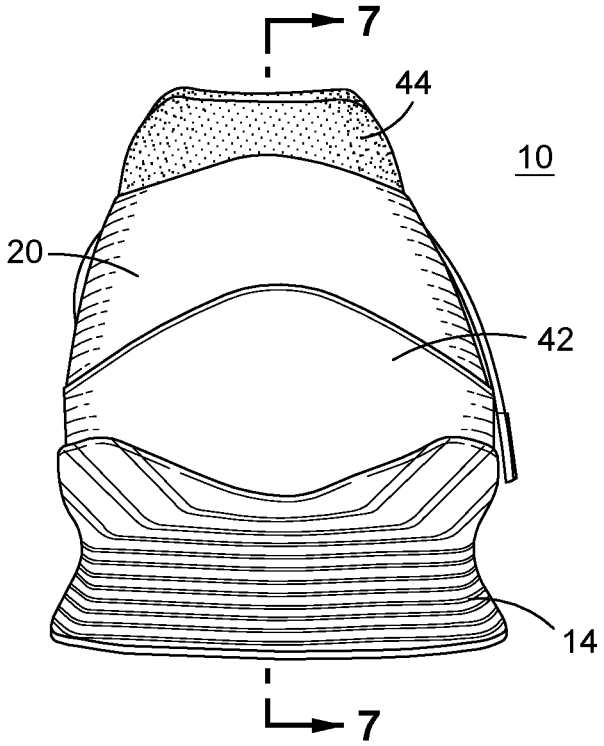
FIG. 6 is a rear view of the weightlifting shoe.

The present disclosure encompasses various embodiments of weightlifting shoes. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

FIGS. 1-7 are views of a weightlifting shoe 10 for a left foot. While not separately illustrated, the weightlifting shoe 10 may also be symmetrically designed for a right foot. The resulting pair of weightlifting shoes 10 may advantageously be worn by a weightlifter in order to optimize performance during a squat. The weightlifting shoe 10 may include a bottom sole 12 (which may be made of rubber, for example), a midsole 14 comprising a stiff thermoplastic polyurethane (TPU) for strong support and stability, and one or more panels 20, which may be attached to one or both of the midsole 14 and the bottom sole 12 to define an enclosure for a person's foot. The panel(s) 20, which may be made of microfiber, for example, may comprise an upper, vamp, quarter, etc. that surround the foot while the weightlifting shoe 10 is being worn. As compared with conventional weightlifting shoes, the enclosure defined by the attachment of the panel(s) 20 to the midsole 14 and/or bottom sole 12 may provide more room for the weightlifter's toes, allowing the weightlifter to full splay his/her toes during a squat as is not possible with conventional weightlifting shoes, even those designed for wide feet. As a result, the weightlifting shoe 10 may improve the weightlifter's performance and stability.

Figure 7:
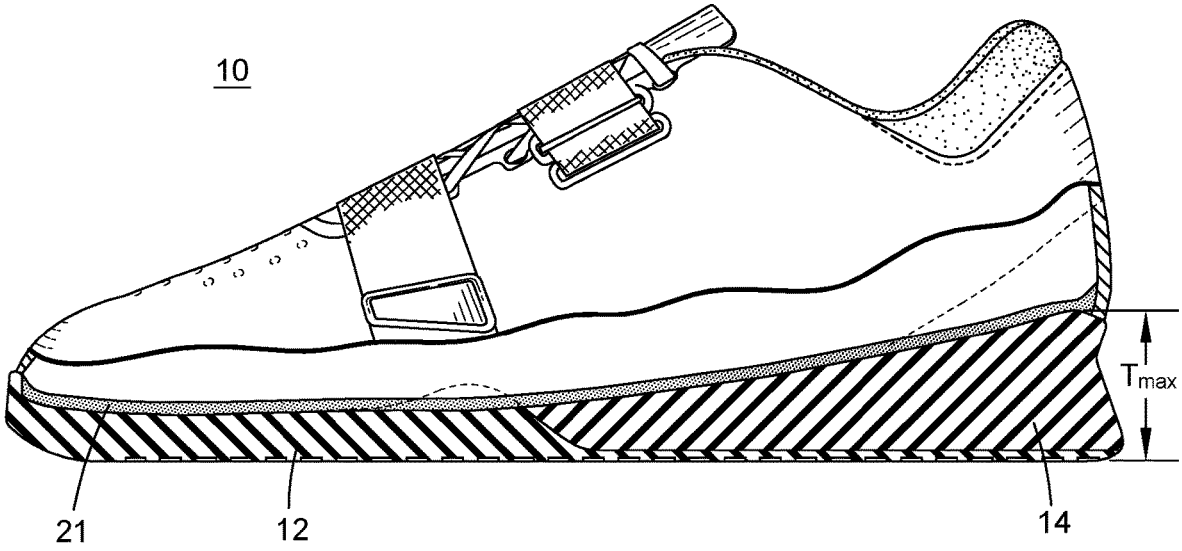
FIG. 7 is a partial cross-sectional view of the weightlifting shoe taken along the line 7-7 in FIG. 6.

As best seen in FIG. 1 and in the cross-sectional view of FIG. 7 (which is taken along the line 7-7 in the rear view of FIG. 6), the midsole 14 may be disposed above at least a portion of the bottom sole 12 and may have a decreasing thickness in a direction from a rear region 16 of the bottom sole 12 toward a front region 18 of the bottom sole 12 opposite the rear region 16. In particular, a heel height Tmax (see FIG. 7) defined as a sum of a maximum value of the thickness of the midsole 14 and a corresponding thickness of the bottom sole 12 (i.e., the combined thicknesses of the midsole 14 and bottom sole 12 where the midsole 14 is at its thickest) may be at least 18 mm, preferably 20 mm or more. An insole 21 (e.g., a removable insole) may be provided over the midsole 14 and, in a case where the midsole 14 is not disposed above the entire bottom sole 12, over the bottom sole 12 as well as shown in FIG. 7, serving as an unbroken surface for the person's foot.

Figure 8:
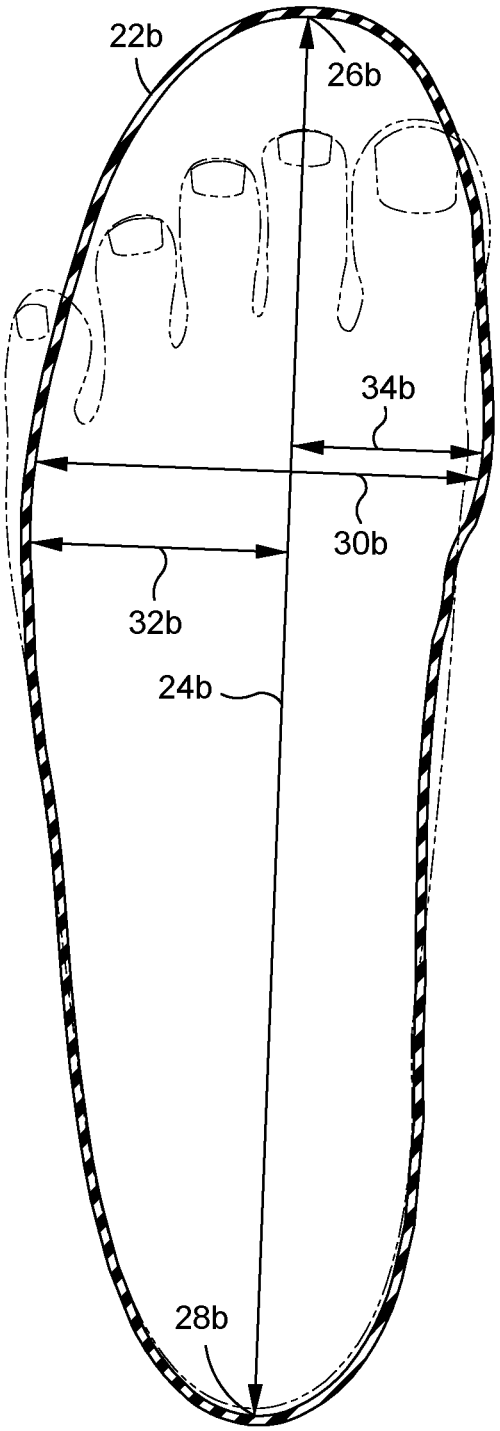
FIG. 8 (PRIOR ART)
FIG. 8 shows an outline of an enclosure for a person's foot that is defined by a conventional weightlifting shoe.
Figure 9:
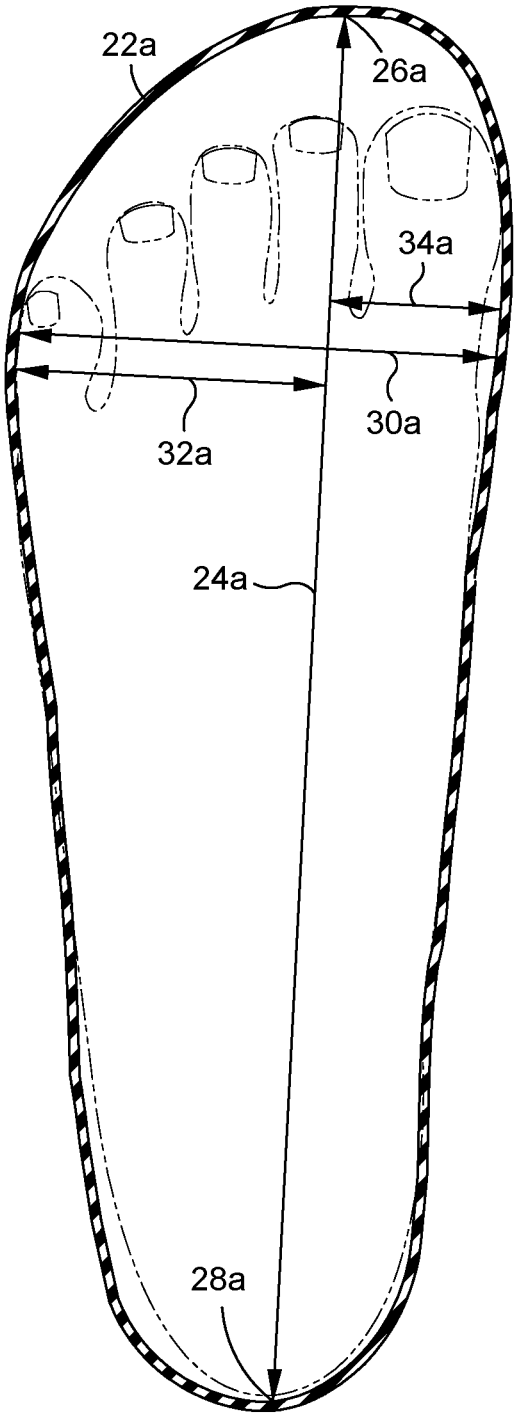
FIG. 9 shows an outline of an enclosure for a person's foot that is defined by the weightlifting shoe shown in FIGS. 1-7 and described herein.

FIG. 9 shows an outline **22*a* of the enclosure for the person's foot that is defined by the weightlifting shoe 10, e.g., by the attachment of the panel(s) 20 to the midsole 14 and/or bottom sole 12. The enclosure may have an axis 24*a* defined between opposing front and rear points 26*a*, 28*a* on the enclosure at the longest part thereof. The outline 22*a* shown in FIG. 9, which typically corresponds to the shape of the insole 21 viewed from above, may represent a slice of the enclosure at this longest part (and thus points 26*a* and 28*a* fall on the outline 22*a* as shown). As shown in FIG. 9, a person's foot can comfortably and completely fit within the outline 22*a* (and thus within the enclosure) while in a relaxed state, even in the area of the toes (known as the toe box of the shoe). More particularly, the enclosure represented by the outline 22*a* may have a width that is defined perpendicular to the axis 24*a*, and the width may have a maximum value 30*a* at a position along the axis 24*a* that is more than 70% of the way from the rear point 28*a* to the front point 26*a*. Because the maximum value 30*a* of the width is positioned this far forward, the weightlifting shoe 10 may be prevented from narrowing too early and closing in on the person's toes as is typical of conventional weightlifting shoes. Because the person's toes are not overly confined by a narrow toe box and can fit comfortably while in a relaxed state as shown in FIG. 9, the person is able to splay his/her toes during a squat for improved weightlifting performance. Preferably, the maximum value 30***a* of the width of the enclosure is at a position along the axis 24*a* that is more than 71% of the way from the rear point 28*a* to the front point 26*a*, more preferably 72%, 73%, 74%, 75%, or more. In contrast, as shown in FIG. 8 in relation to an outline 22*b* of an enclosure similarly defined by a conventional weightlifting shoe, the maximum value 30*b* of the width perpendicular to the axis 24*b* (defined similarly between opposing front and rear points 26*b*, 28*b*) is significantly less far forward, resulting in a narrow toe box. As can be seen, the person's toes cannot comfortably fit and must be scrunched up in the conventional weightlifting shoe, making splaying of the toes much more difficult or impossible.

Referring again to FIG. 9, the enclosure defined by the weightlifting shoe 10 may, alternatively or additionally, have wider space to the left and/or right of the axis 24*a* relative to conventional weightlifting shoes. In other words, instead of or in addition to defining a wider toe box generally, the outline 22*a* of the enclosure may define a wider area for the person's big toe and/or a wider area for the person's second, third, fourth, and fifth toes. In particular, given that the axis 24*a* is defined between opposing front and rear points 26*a*, 28*a* on the enclosure at the longest part thereof, the width of the enclosure (perpendicular to the axis 24*a*) may be thought of as the sum of an outer foot distance and an inner foot distance. The outer foot distance may be defined perpendicular to the axis 24*a* between the axis 24*a* and the enclosure where the enclosure encloses an outer part of the person's foot (the left-hand side in FIG. 9), while the inner distance may be defined perpendicular to the axis 24*a* between the axis 24*a* and the enclosure where the enclosure encloses an inner part of the person's foot (the right-hand side in FIG. 9). In order to define a wide area for the person's toes other than the big toe, the outer foot distance may have a maximum value 32*a* at a position along the axis 24*a* that is more than 66% of the way from the rear point 28*a* to the front point 26*a*. Preferably, the maximum value 32*a* of the outer foot distance may be at a position along the axis 24*a* that is more than 67% of the way from the rear point 28*a* to the front point 26*a*, more preferably 68%, 69%, 70%, or more. Along the same lines, in order to define a wide area for the person's big toe, the inner foot distance may have a maximum value 34*a* at a position along the axis 24*a* that is more than 72% of the way from the rear point 28*a* to the front point 26*a*. Preferably, the maximum value 34*a* of the inner foot distance may be at a position along the axis 24*a* that is more than 73% of the way from the rear point 28*a* to the front point 26*a*, more preferably 74%, 75%, 76%, 77%, 78%, 79%, 80%, or more. In contrast, as shown in FIG. 8 in relation to the outline 22*b* of the enclosure defined by the conventional weightlifting shoe, both the maximum value 32*b* of the outer foot distance and the maximum value 34*b* of the inner foot distance (defined similarly) are significantly less far forward, resulting in narrow areas for the toes and making splaying of the toes difficult or impossible on both sides of the foot.

Figure 10:
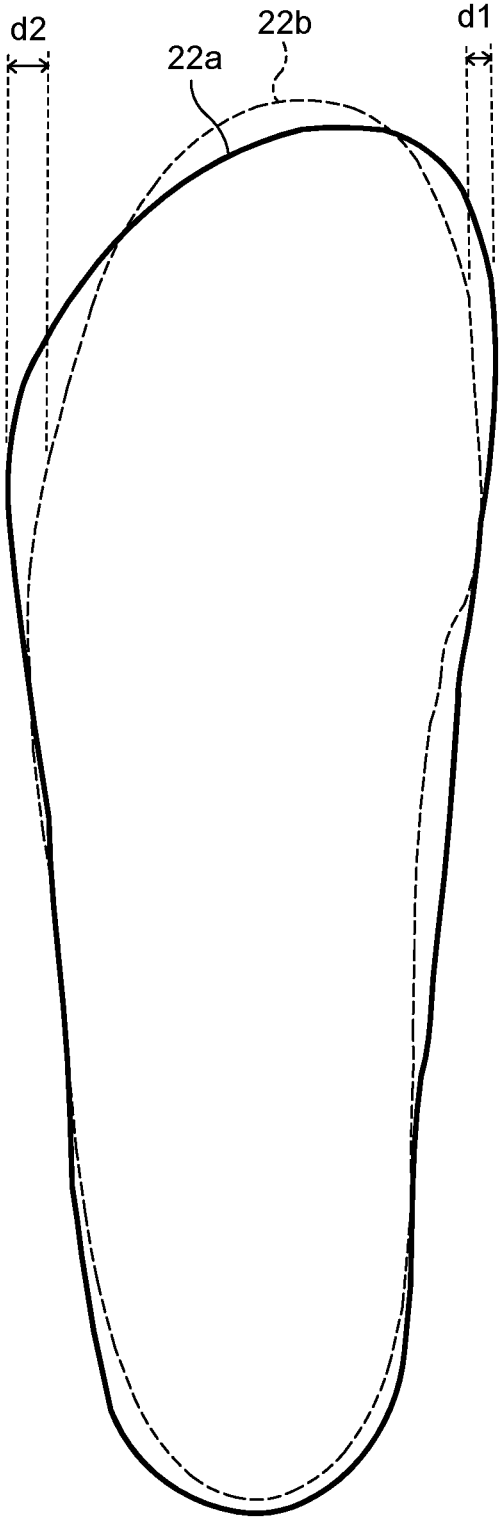
FIG. 10 shows a comparison between the outlines of FIGS. 8 and 9.
Figure 11:
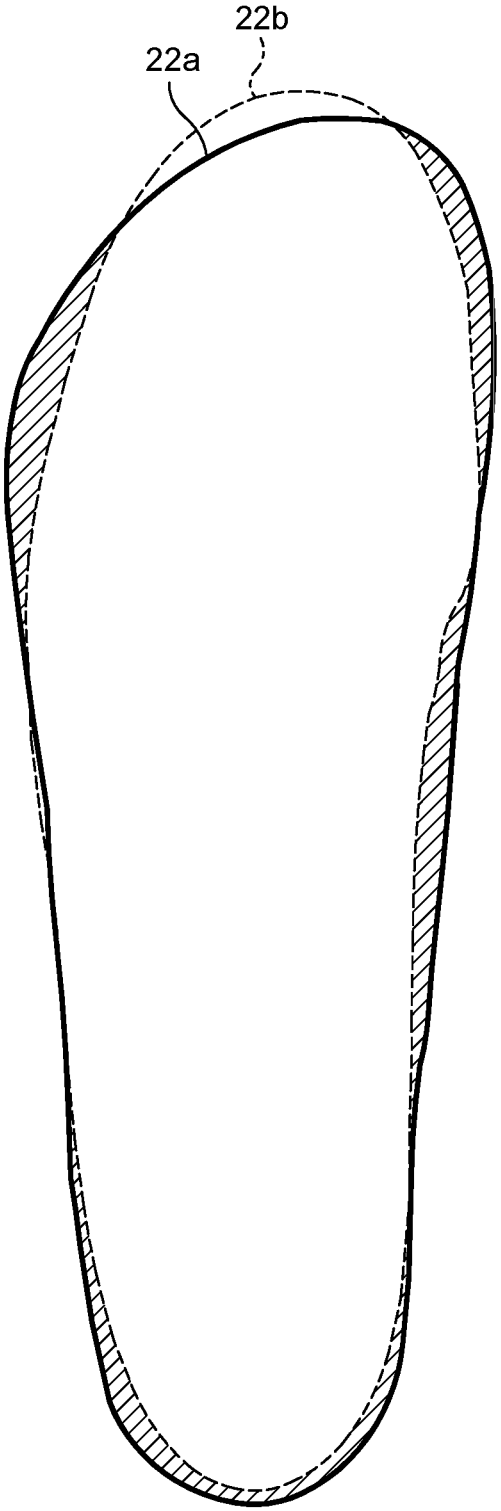
FIG. 11 shows another comparison between the outlines of FIGS. 8 and 9.

FIGS. 10 and 11 show comparisons superimposing the outline 22*b* of the conventional weightlifting shoe of FIG. 8 on the outline 22*a* of the innovative weightlifting shoe 10 disclosed herein. As shown in FIG. 10, the toe box of the weightlifting shoe 10 may provide additional width d1 at the inner part of the person's foot as well as additional width d2 at the outer part of the person's foot, resulting in a weightlifting shoe 10 that may be 6-10% wider than other weightlifting shoes available on the market. Depending on which conventional weightlifting shoe is compared with, the additional width d1 at the inner part of the person's foot may be 2-3 mm, for example, while the additional width d2 at the outer part of the person's foot may be 3-5 mm, for example. In FIG. 11, the shaded regions show increased room that may be provided by the disclosed weightlifting shoe 10 in these areas of the toe box as well as elsewhere. In general, the natural foot-shaped design of the weightlifting shoe 10 may provide better comfort for the wearer while allowing the wearer to splay his/her toes for improved performance and stability.

Referring back to FIGS. 1-6, the weightlifting shoe 10 may have, in addition to a plurality of shoelace eyelets 36 for threading shoelaces 38, two or more straps 40 for further securing the weightlifting shoe 10 to the person's foot. As best seen in FIGS. 1-3 and 5, the straps 40 may include one strap 40 over the middle of the foot and another strap 40 around the ankle for maximized support, stability, and lockdown fit. The straps 40 may comprise a nylon and Velcro strap webbing and may be held in place by strap holders made of silicone, for example. Additional features of the weightlifting shoe 10 may include a TPU back heel support 42 and a mesh inner fabric 44 and tongue 46 that may border the panel(s) 20 and may in some cases be thought of as further defining, in part, the enclosure described herein.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A weightlifting shoe comprising:

a bottom sole;

a midsole disposed above at least a portion of the bottom sole and having a decreasing thickness in a direction from a rear region of the bottom sole toward a front region of the bottom sole opposite the rear region;

one or more panels attached to one or both of the midsole and the bottom sole to define an enclosure for a person's foot; and an insole having an axis defined between opposing front and rear points at a longest part thereof and having a width defined perpendicular to the axis, the width of the insole having a maximum value at a position along the axis that is more than 70% of the way from the rear point to the front point.

2. The weightlifting shoe of claim 1, wherein the maximum value of the width of the insole is at a position along the axis that is more than 71% of the way from the rear point to the front point.

3. The weightlifting shoe of claim 2, wherein the maximum value of the width of the insole is at a position along the axis that is more than 72% of the way from the rear point to the front point.

4. The weightlifting shoe of claim 1, wherein the width of the insole is the sum of an outer foot distance defined perpendicular to the axis where the enclosure encloses an outer part of the person's foot and an inner foot distance defined perpendicular to the axis where the enclosure encloses an inner part of the person's foot, the outer foot distance having a maximum value at a position along the axis that is more than 66% of the way from the rear point to the front point.

5. The weightlifting shoe of claim 4, wherein the maximum value of the outer foot distance is at a position along the axis that is more than 68% of the way from the rear point to the front point.

6. The weightlifting shoe of claim 5, wherein the maximum value of the outer foot distance is at a position along the axis that is more than 70% of the way from the rear point to the front point.

7. The weightlifting shoe of claim 1, wherein the width of the enclosure is the sum of an outer foot distance defined perpendicular to the axis where the enclosure encloses an outer part of the person's foot and an inner foot distance defined perpendicular to the axis where the enclosure encloses an inner part of the person's foot, the inner foot distance having a maximum value at a position along the axis that is more than 72% of the way from the rear point to the front point.

8. The weightlifting shoe of claim 7, wherein the maximum value of the inner foot distance is at a position along the axis that is more than 74% of the way from the rear point to the front point.

9. The weightlifting shoe of claim 8, wherein the maximum value of the inner foot distance is at a position along the axis that is more than 76% of the way from the rear point to the front point.

10. The weightlifting shoe of claim 1, wherein a heel height defined as a sum of a maximum value of the thickness of the midsole and a corresponding thickness of the bottom sole is at least 18 mm.

11. The weightlifting shoe of claim 10, wherein the heel height is at least 20 mm.

12. The weightlifting shoe of claim 1, further comprising a plurality of shoelace eyelets and two or more straps.

13. A weightlifting shoe comprising:

a bottom sole;

a midsole disposed above at least a portion of the bottom sole and having a decreasing thickness in a direction from a rear region of the bottom sole toward a front region of the bottom sole opposite the rear region;

one or more panels attached to one or both of the midsole and the bottom sole to define an enclosure for a person's foot; and an insole having an axis defined between opposing front and rear points at a longest part thereof and having a width defined perpendicular to the axis, the width of the insole being the sum of an outer foot distance defined perpendicular to the axis where the enclosure encloses an outer part of the person's foot and an inner foot distance defined perpendicular to the axis where the enclosure encloses an inner part of the person's foot, the outer foot distance having a maximum value at a position along the axis that is more than 66% of the way from the rear point to the front point.

14. The weightlifting shoe of claim 13, wherein the maximum value of the outer foot distance is at a position along the axis that is more than 68% of the way from the rear point to the front point.

15. The weightlifting shoe of claim 14 wherein the maximum value of the outer foot distance is at a position along the axis that is more than 70% of the way from the rear point to the front point.

16. The weightlifting shoe of claim 13, wherein a heel height defined as a sum of a maximum value of the thickness of the midsole and a corresponding thickness of the bottom sole is at least 18 mm.

17. The weightlifting shoe of claim 16, wherein the heel height is at least 20 mm.

18. The weightlifting shoe of claim 13, further comprising a plurality of shoelace eyelets and two or more straps.

19. A weightlifting shoe comprising:

a bottom sole;

a midsole disposed above at least a portion of the bottom sole and having a decreasing thickness in a direction from a rear region of the bottom sole toward a front region of the bottom sole opposite the rear region;

one or more panels attached to one or both of the midsole and the bottom sole to define an enclosure for a person's foot; and an insole having an axis defined between opposing front and rear points at a longest part thereof and having a width defined perpendicular to the axis, the width of the insole being the sum of an outer foot distance defined perpendicular to the axis where the enclosure encloses an outer part of the person's foot and an inner foot distance defined perpendicular to the axis where the enclosure encloses an inner part of the person's foot, the inner foot distance having a maximum value at a position along the axis that is more than 72% of the way from the rear point to the front point.

20. The weightlifting shoe of claim 19, wherein the maximum value of the inner foot distance is at a position along the axis that is more than 76% of the way from the rear point to the front point.

21. The weightlifting shoe of claim 19, wherein a heel height defined as a sum of a maximum value of the thickness of the midsole and a corresponding thickness of the bottom sole is at least 18 mm.

22. The weightlifting shoe of claim 21, wherein the heel height is at least 20 mm.

23. The weightlifting shoe of claim 19, further comprising a plurality of shoelace eyelets and two or more straps.

24. The weightlifting shoe of claim 1, wherein the midsole comprises a thermoplastic polyurethane (TPU).

25. The weightlifting shoe of claim 13, wherein the midsole comprises a thermoplastic polyurethane (TPU).

26. The weightlifting shoe of claim 19, wherein the midsole comprises a thermoplastic polyurethane (TPU).

* * * * *